US005165835A

United States Patent [19]

Schäfer

[11] Patent Number: 5,165,835

[45] Date of Patent: Nov. 24, 1992

[54] GARBAGE DISPOSAL SYSTEM

[75] Inventor: Gerhard Schäfer, Neunkirchen-Salchendorf, Fed. Rep. of Germany

[73] Assignee: Fritz Schafer Gesellschaft Mit beschrankter Haftung, Neunkirchen, Fed. Rep. of Germany

[21] Appl. No.: 678,540

[22] Filed: Mar. 20, 1991

[30] Foreign Application Priority Data

Mar. 21, 1990 [DE] Fed. Rep. of Germany ..... 4009060

[51] Int. Cl.[5] ..... B65F 3/04

[52] U.S. Cl. ..... 414/406; 294/68.3; 294/90

[58] Field of Search ..... 294/68.3, 90; 414/303, 414/404, 406, 407, 408, 409, 421, 618

[56] References Cited

U.S. PATENT DOCUMENTS

| | | | |
|---|---|---|---|
| 3,016,157 | 1/1962 | Brisson | 414/408 |
| 3,747,785 | 7/1973 | Dahlin | 414/303 |
| 3,874,534 | 4/1975 | Brisson | 414/406 |
| 4,687,405 | 8/1987 | Olney | 414/408 |
| 4,715,767 | 12/1987 | Edelhoff et al. | 414/408 |
| 4,722,658 | 2/1988 | Würtz et al. | 414/408 |
| 4,726,726 | 2/1988 | Dossana et al. | 414/408 |
| 4,886,411 | 12/1989 | Pieperhoff et al. | 414/409 X |
| 4,936,732 | 6/1990 | Naab et al. | 414/408 |
| 4,978,268 | 12/1990 | Winwood et al. | 414/409 |
| 4,983,092 | 1/1991 | Richards | 414/408 |

FOREIGN PATENT DOCUMENTS

| | | | |
|---|---|---|---|
| 0098528 | 1/1984 | European Pat. Off. . | |
| 0178491 | 4/1986 | European Pat. Off. . | |
| 257442 | 3/1988 | European Pat. Off. | 414/408 |
| 0288066 | 10/1988 | European Pat. Off. . | |
| 354256 | 2/1990 | European Pat. Off. | 414/408 |
| 3420058 | 12/1985 | Fed. Rep. of Germany . | |
| 3703034 | 4/1988 | Fed. Rep. of Germany . | |
| WO/8303242 | 9/1983 | Int'l Pat. Institute | 414/409 |
| 2165814 | 4/1986 | United Kingdom | 414/406 |

*Primary Examiner*—David A. Bucci
*Assistant Examiner*—Robert S. Katz
*Attorney, Agent, or Firm*—Anderson Kill Olick & Oshinsky

[57] ABSTRACT

A garbage disposal system including garbage containers, a garbage-collecting vehicle and a lifting and tilting unit. The lifting and tilting unit includes a receiving member which can be temporarily coupled to an edge structure of each garbage container. The edge structure is located on a front wall of the container body opposite the hinges of the hinged cover of the garbage container. The receiving member has along its edge portion corresponding to the edge structure of the garbage container tooth-type contours which are oriented parallel to and transversely of the principal plane edge structure. The tooth-type contour oriented parallel to the principal plane has top surfaces extending essentially transversely of the principal plane and the tooth-type contour oriented transversely of the principal plane has end surfaces extending approximately parallel to the principal plane. The top surfaces and the end surfaces are each located on a common straight line. The tooth gaps between the tooth-type contours extending in a backward direction from the straight lines are defined by surfaces which have a shape which is adapted to the positions of individual ribs or webs and/or rib or web systems provided on the front side of each container body.

17 Claims, 9 Drawing Sheets

GARBAGE DISPOSAL SYSTEM

BACKGROUND OF THE INVENTION

1. Field of the Invention

The present invention relates to a garbage disposal system which includes garbage containers, a garbage-collecting vehicle and a lifting and tilting unit arranged on the garbage-collecting vehicle. The lifting and tilting unit includes a receiving member forming a gripping member or a gripping rail which can be temporarily coupled to an edge structure forming a receiving pocket of the garbage container. The edge structure of the garbage container is located on a front wall of the container body opposite the hinges of the hinged cover of the garbage container. In the region of engagement of the gripping member or gripping rail or of the receiving member, the receiving pocket or edge structure of the garbage containers used in such garbage disposal systems are divided by means of individual ribs or webs or by rib or web systems into several pocket sections which are distributed along the front side of the container body.

2. Description of the Related Art

Garbage disposal systems of the above-described type are well known and are in continuous practical use. Further improvements of such garbage disposal systems are continuously developed, particularly in order to increase the efficiency and the practical service life of the garbage disposal systems Examples for such further developments are described, for example, in EP-A No. 0 098 528, EP-A No. 0 178 491, EP-A No. 0 288 066, DE-A No. 34 20 058 and EP-C 37 03 034.

The new and further developments for improving garbage disposal systems of this type are directed primarily to the construction of the garbage container in order to increase the usefulness of the container because the container is that element of the garbage disposal system which not only is used in a relatively large number but additionally forms the most sensitive link within the garbage disposal chain.

However, improvements of the garbage containers can only be introduced in practice without problems if they are compatible with the remaining links in the already existing garbage disposal system. In other words, the garbage disposal system must be capable of receiving, lifting and tilting the containers at least as well as is the case with respect to the garbage containers already in use.

The so-called receiving member of the lifting and tilting unit operated on the garbage-collecting vehicles, which receiving member is constructed as a gripping member or gripping rail, must be compatible with the edge structures of the garbage containers which are in practical use, because otherwise it would not be possible to avoid substantial difficulties when conversions are carried out in already existing garbage disposal systems.

When garbage collecting vehicles are used which have several lifting and tilting units, it is possible to equip these lifting and tilting units with different receiving members if different types of garbage containers are used simultaneously. However, such an arrangement means that the garbage collecting process is substantially impaired because the two lifting and tilting units cannot usually be used simultaneously.

Another possibility for emptying simultaneously used garbage containers with different edge structures is to provide the receiving members of the lifting and tilting units with special adapters which are particularly adapted to the edge structure of a certain type of the simultaneously used different types of garbage containers.

The above-described possibility is proposed, for example, in DE-A No. 0 185 382. In this case, an adapter is proposed which can be used in conjunction with a receiving member as disclosed by DE-A No. 34 20 058, in order to make it only for emptying garbage containers of novel construction but also garbage containers of the old type.

However, in such a case it is a disadvantage that the adapter must be always available at the garbage-collecting vehicle in such a way that it can be placed on or removed from the conventional receiving member as required, usually in an irregular sequence.

SUMMARY OF THE INVENTION

Therefore, it is an object of the present invention to provide a garbage disposal system which makes it possible, with any lifting and tilting unit operated on a garbage collecting vehicle and with the use of only one type of receiving member, not only to empty without problems garbage containers with different types of edge structures, but also to empty garbage containers having different volumes and, thus, different structural sizes.

In accordance with the present invention, the receiving member constructed as gripping member or gripping rail of the lifting and tilting unit is equipped along its edge portions corresponding to the receiving pocket or edge structure of the garbage container with tooth-type contours which are oriented parallel as well as transversely of the principal plane of the edge structure. The tooth-type contour oriented parallel to the principal plane has top surfaces extending essentially transversely of the principal plane and the tooth-type contour oriented transversely of the principal plane has end surfaces extending approximately parallel to the principal plane. The top surfaces and the end surfaces are each located on a common straight line. The tooth gaps between the tooth-type contours extending in a backward direction from these straight lines are defined by surfaces which have a shape which is adapted to the positions of the individual ribs or webs and/or rib or web systems of different garbage containers.

The features proposed according to the present invention make it possible, when new improved garbage containers are incorporated into an already existing garbage disposal system, that the garbage containers which are already in use can also be used until the end of their service life. This can be done simply by replacing the old receiving members of the lifting and tilting unit by new receiving members according to the present invention. This can be done because the receiving members according to the present invention are also compatible with the edge structures of the already existing garbage containers.

In accordance with another proposal of the present invention, the tooth-type contour oriented in the direction of the principal plane of the receiving member includes four trapezoidally-shaped teeth and three tooth gaps, wherein the two outer tooth gaps are also trapezoidally-shaped, while the tooth gap in the middle has at least approximately a triangular shape.

In accordance with a particularly advantageous feature, the tooth gap in the middle has a depth which corresponds to a multiple, for example, three to four times the depth of each outer tooth gap.

However, the two outer tooth gaps may also have the same depth.

In accordance with a further development, the outer trapeze sides of the two outer teeth extend with constant inclination at least approximately over the entire height of the receiving member.

In accordance with the most important further development of the invention, the greatest width of the triangular tooth gap in the middle is substantially greater than the greatest width of the two outer tooth gaps. For example, the greatest width of the tooth gap in the middle is twice the greatest width of the outer tooth gaps.

In accordance with another important feature, the tooth-type contour oriented transversely of the principal plane of the receiving member is formed by four teeth and four tooth gaps, wherein the two outer tooth gaps are each located in the region of an outer tooth gap of the other tooth-type contour, while the two inner tooth gaps follow the sides of the tooth gap in the middle of the other tooth-type contour.

It has also proved useful in accordance with the present invention that the two outer tooth gaps each have the shape of a groove which diverges from bottom to top in the shape of a pyramid, while the two tooth gaps in the middle are formed by incisions in the sides of the tooth gap in the middle of the other tooth-type contour, wherein the two tooth gaps in the middle have in the direction of the principal plane of the receiving member the shape of a right-angled triangle whose smallest angle is directed upwardly, while the tooth gaps in the middle have in the direction transversely of the principal plane of the receiving member the shape of a right-angled triangle whose smallest angle faces downwardly.

Another feature of the invention provides that each inner side of the two outer tooth gaps is arranged in a straight-line extension of the inner side of an outer tooth gap of the other tooth-type contour.

In accordance with another important feature of the present invention, the total width of the receiving member in the region of the tooth-type contour oriented in the direction of the principal plane is adapted to the structural width of the edge structure of garbage containers having an average volumetric capacity of, for example, 0.12 to 0.24 $m^3$, while the outer tooth gaps of this tooth-type contour each have an opening width which corresponds at least to the cross-section of a stiffening collar which is located adjacent the edge structure along the side walls of the garbage container body.

On the other hand, in accordance with another feature, the distance between the outer side of an outer tooth and the inner side of an outer tooth gap adjacent the other outer tooth is adapted to the inside dimension of the edge structure of a garbage container having a small volumetric capacity of, for example, 0.08 $m^3$.

In addition, the distance between the inner sides of the two outer tooth gaps is also adapted to the inside dimension of the edge structure of a garbage container having a small volumetric capacity of, for example, 0.08 $m^3$.

In accordance with another important feature of the invention, the edge structure of the garbage container of the garbage disposal system has a central rib or web system which narrows downwardly in the shape of a triangle and which forms a support and centering engagement for the approximately triangular tooth gap in the middle of the receiving member of the lifting and tilting unit.

It has been found that the conversion of already operating garbage disposal systems is in no way impaired by garbage containers constructed as described above, because it is only necessary to exchange the receiving members provided on the lifting and tilting units of the garbage-collecting vehicles against receiving members of the new type. This can be done because the new receiving members also ensure that the garbage containers which are still in use can be emptied without problems.

In accordance with another feature, the outer wall of the edge structure forming the receiving pocket has a border which also narrows downwardly approximately in the shape of flat triangle, wherein the border is provided at the outside with stiffening ribs or webs which are arranged distributed over the entire surface. Consequently, the edge structure of the garbage container is particularly stable.

Finally, another feature provides that the downwardly directed triangle ends of the support and centering engagement means and of the outer wall of the edge structure or receiving pocket are located above the lower ends of stacking webs formed on the outer circumference of the container body. This makes it possible to stack the empty garbage containers within each other and, thus, to store the garbage containers in a space-saving manner.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENT

Figure 1:
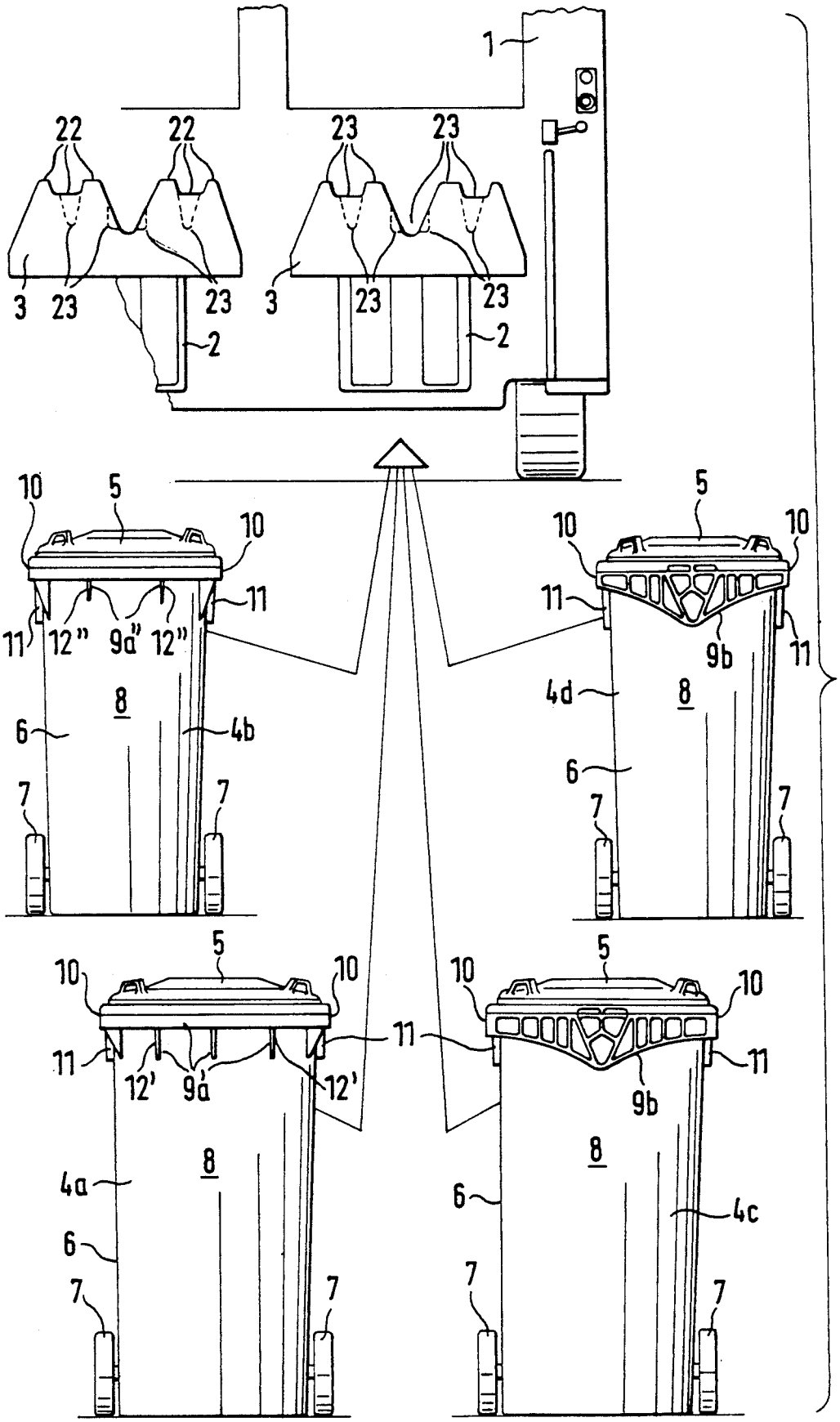
FIG. 1 is a schematic view of a garbage disposal system according to the present invention including a garbage-collecting vehicle with lifting and tilting units and receiving members and several types of garbage containers with different volumetric capacities.

FIG. 1 of the drawing is a schematic illustration of a garbage disposal system according to the present invention which includes as system components garbage-collecting vehicles 1 with lifting and tilting units 2 and receiving members 3 mounted on the lifting and tilting units 2 as well as several, for example, four, different garbage containers 4*a*, 4*b*, 4*c*, 4*d*.

The garbage containers 4*a* and 4*b* are of an older conventional type while the garbage containers 4*c* and 4*d* are of newer improved type. The two garbage containers 4*a* and 4*c* have the same filling volume, for example, an average filling volume of between 0.12 and 0.24 $m^3$, while the garbage containers 4*b* and 4*d* are designed for smaller volumetric capacities, for example, 0.08 $m^3$.

Of course, the garbage disposal system may also include garbage containers which are designed for greater filling volumes, for example, 0.36 $m^3$.

Each type of garbage container 4*a*–4*d* which is part of the garbage disposal system has a container body 6 which can be closed by a hinged cover 5. In addition, a pair of wheels 7 is attached to the container body 6.

On a front wall 8 located opposite the hinges for the cover 5, the container body 6 of each garbage container 4*a*–4*d* has an edge structure 9*a* or 9*b* which may be constructed, for example, as a receiving pocket. Each edge structure 9*a* or 9*b* forms a coupling engagement means for the receiving member 3 of a lifting and tilting unit 2. The receiving member 3 is constructed as a gripping member or gripping rail.

On the side walls of the container body 6, the edge structures 9*a* and 9*b* extend toward stiffening collars 10 which are provided alongside the side walls as well as along the rear wall of the container body 6 in the region of the container opening. The stiffening collar 10 may be of conventional construction and, therefore, is not explained in detail herein.

It should also be mentioned at this point that the container body 6 of all garbage containers 4*a*, 4*b*, 4*c* and 4*d* has underneath the stiffening collar 10 at least on the side walls additional stacking ribs or webs 11 which make it possible to stack several empty garbage containers 4*a* and 4*c* or 4*b* and 4*d* of the same volume into each other in order to form space-saving stacks of containers, as long as the wheels 7 have been removed or not yet attached.

Although the edge structure 9*a* of the two garbage containers 4*a* and 4*b* is of the same basic type with respect to profiling and dimension of the receiving pockets, the garbage containers still have certain differing features because of the different volumetric capacities of the container body 6. Thus, the edge structure 9*a*' of the garbage container 4*a* should be equipped with individual ribs or webs 12' which have a different arrangement and construction than the individual web or webs 12" on the garbage container 4*b*.

However, in either case, the individual web or webs 12' and 12" serve to stiffen and stabilize the edge structure 9*a*' or 9*a*" relative to the container body 6. The individual web or webs 12' or 2" divide the edge structure 9*a*' or 9*a*" constructed as a receiving pocket into several pocket portions provided on the front side 8 of the container body 6.

The edge structures 9*b* constructed as receiving pockets of the garbage containers 4*c* and 4*d* may be essentially of the same type. The only differences are due to the fact that the edge structures have different structural lengths which, in turn, is due to the fact that the container bodies 6 which have approximately the same structural height must have different cross-sections because of the different volumetric capacities.

Figure 2:
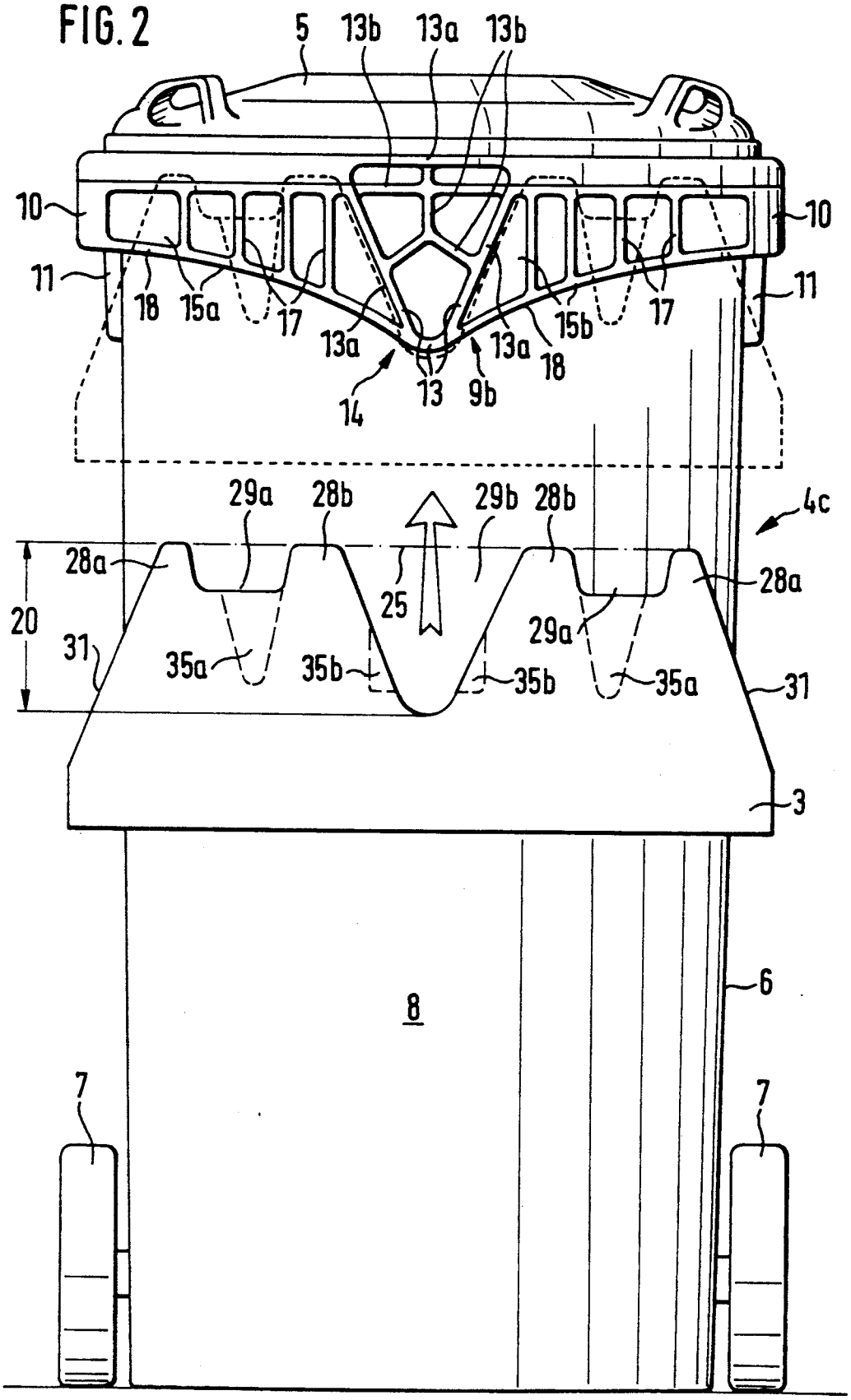
FIG. 2 shows, on a larger scale, the garbage container on the lower righthand side of FIG. 1, together with a receiving member forming a gripping member or gripping rail of a lifting and tilting device of the garbage-collecting vehicle.
Figure 4:
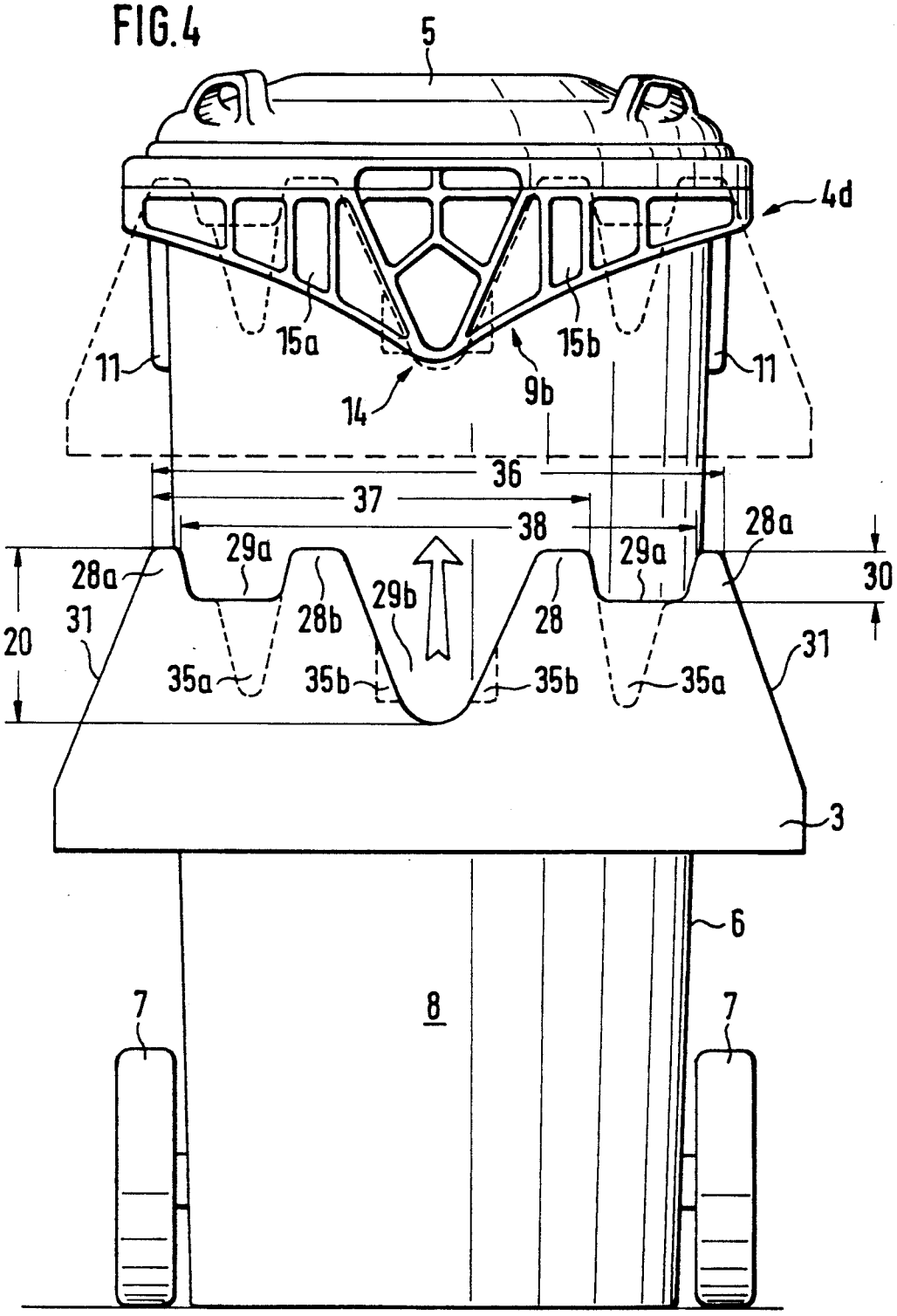
FIG. 4 is an illustration, corresponding to FIG. 2, showing the garbage container on the upper righthand side of FIG. 1.
Figure 9:
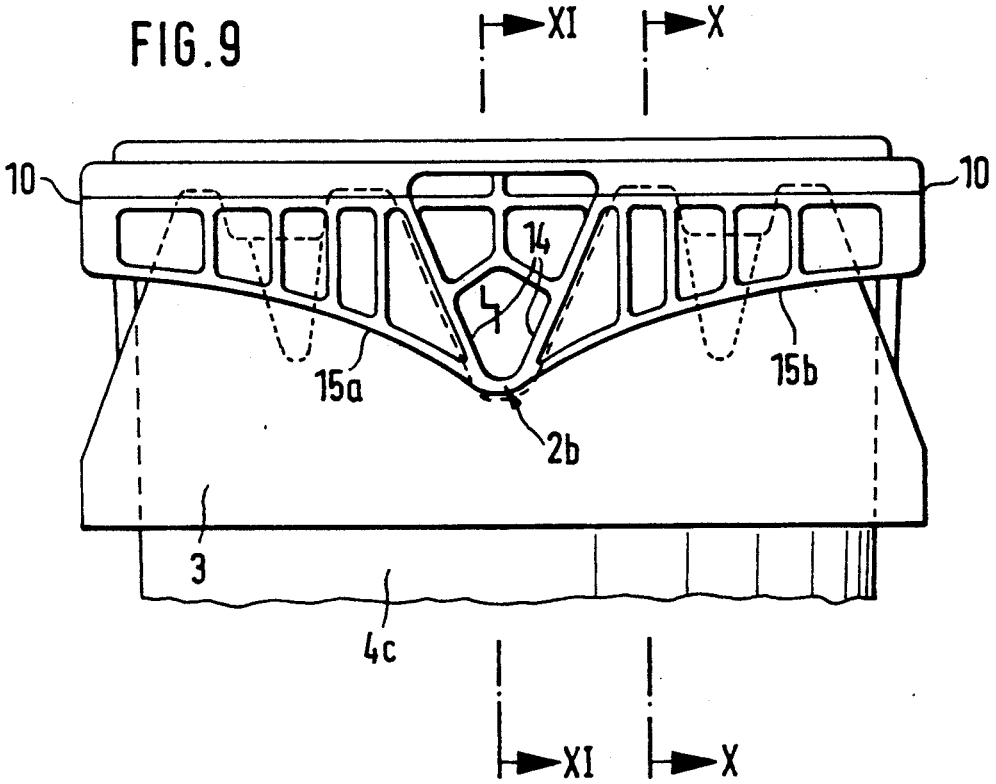
FIG. 9 is a front view of the upper portion of a garbage container of the type shown in FIG. 2, wherein the edge structure of the garbage container is in engagement with a receiving member of the type shown in FIG. 8.
Figure 10:
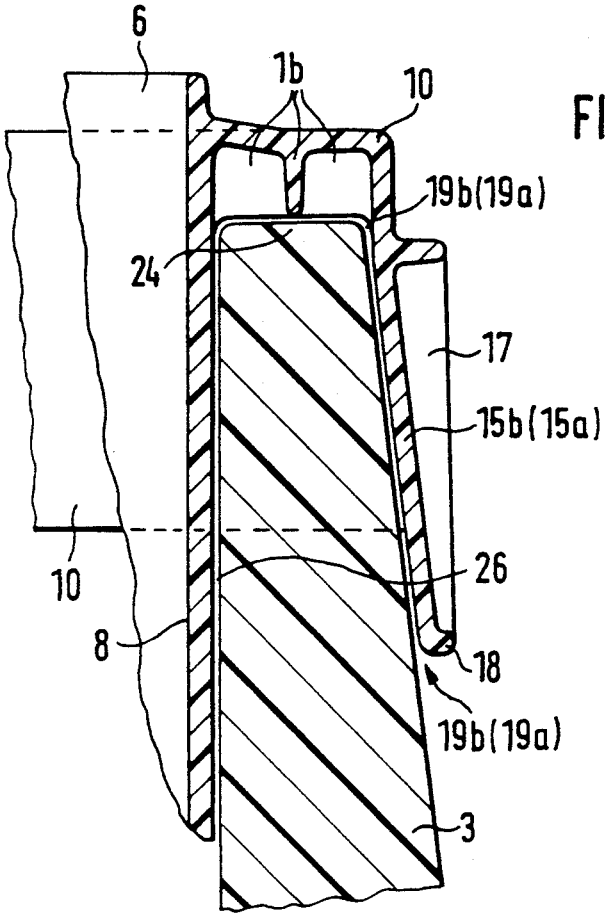
FIG. 10 is a sectional view, on a larger scale, taken along sectional line X—X of FIG. 9.
Figure 11:
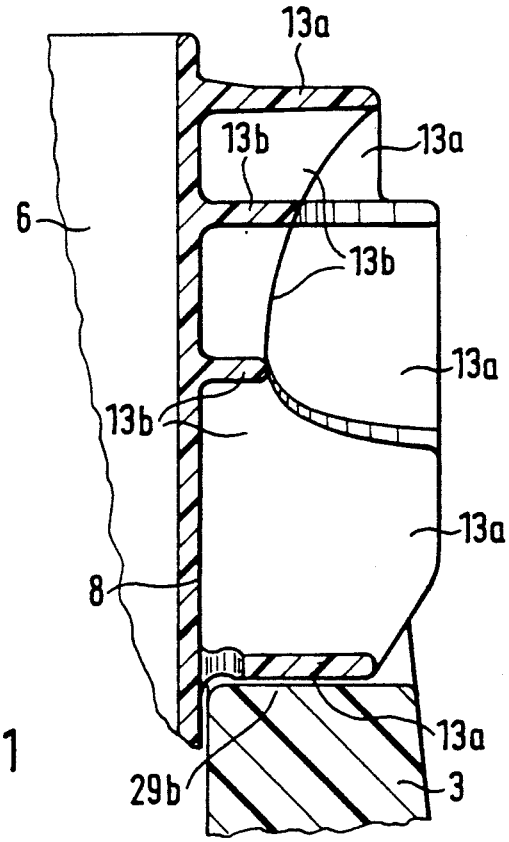
FIG. 11 is a sectional view, on a larger scale, taken along sectional line XI—XI of FIG. 9.

The edge structures 9*b* constructed as receiving pockets for the garbage containers 4*c* and 4*d* are illustrated, on a larger scale compared to FIG. 1, particularly in FIGS. 2, 4 and in FIGS. 9–11 of the drawing. However, the edge structures 9*b* can also be seen in FIGS. 6 and 7 of the drawing.

Figure 3:
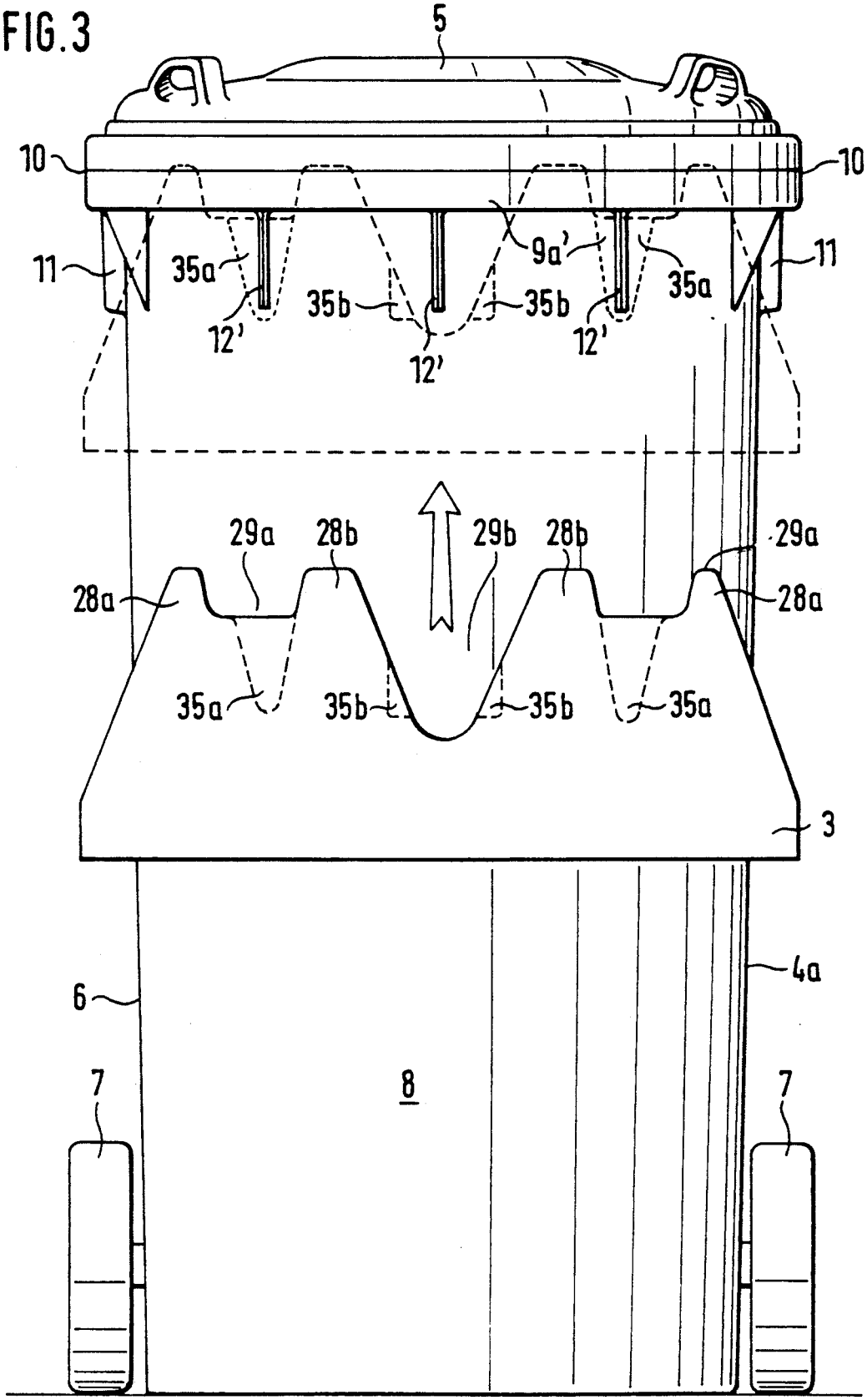
FIG. 3 is an illustration, corresponding to FIG. 2, showing the garbage container on the lower lefthand side of FIG. 1.
Figure 5:
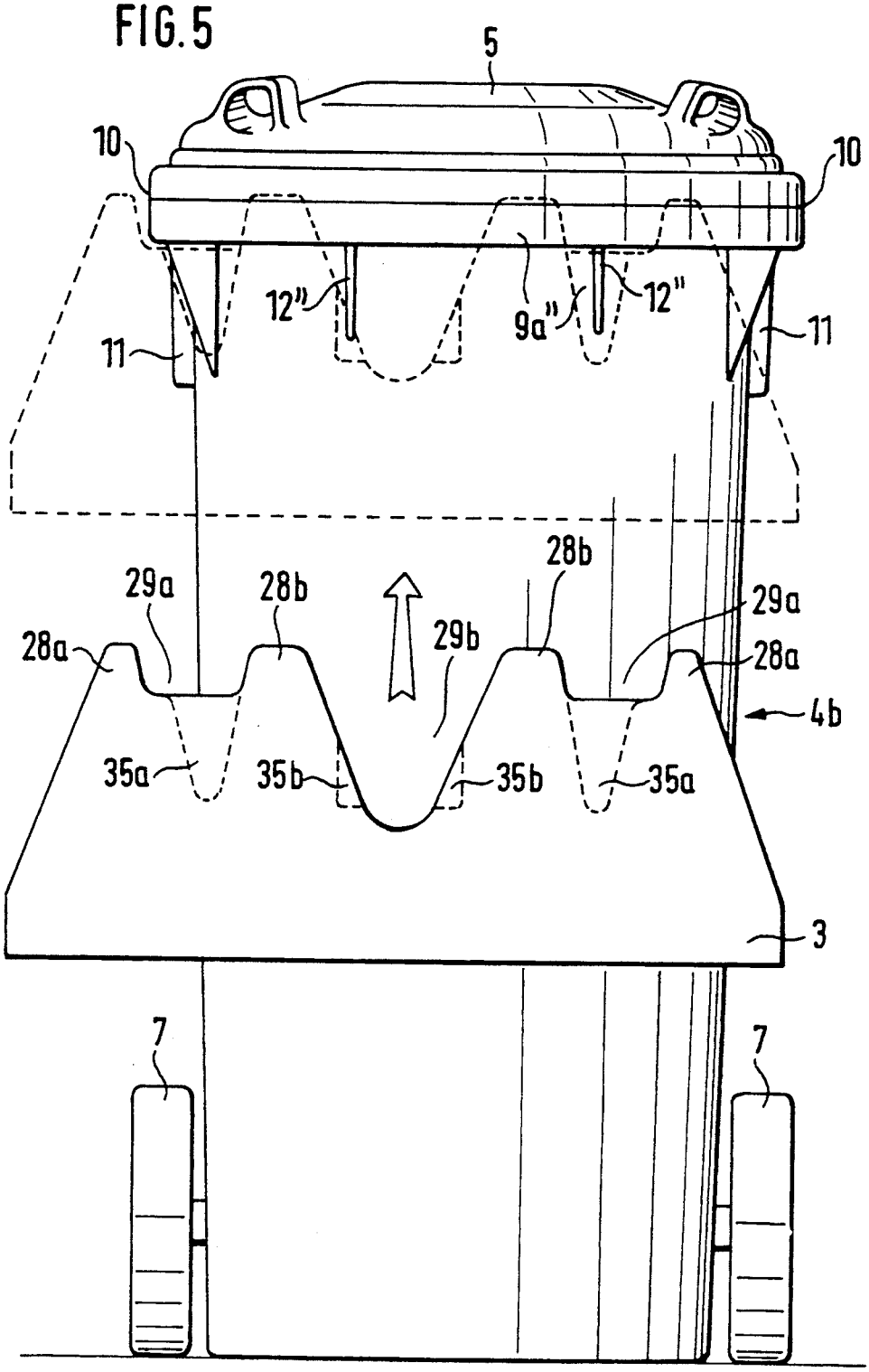
FIG. 5 is an illustration, corresponding to FIG. 2, showing the garbage container on the upper lefthand side of FIG. 1.
Figure 6:
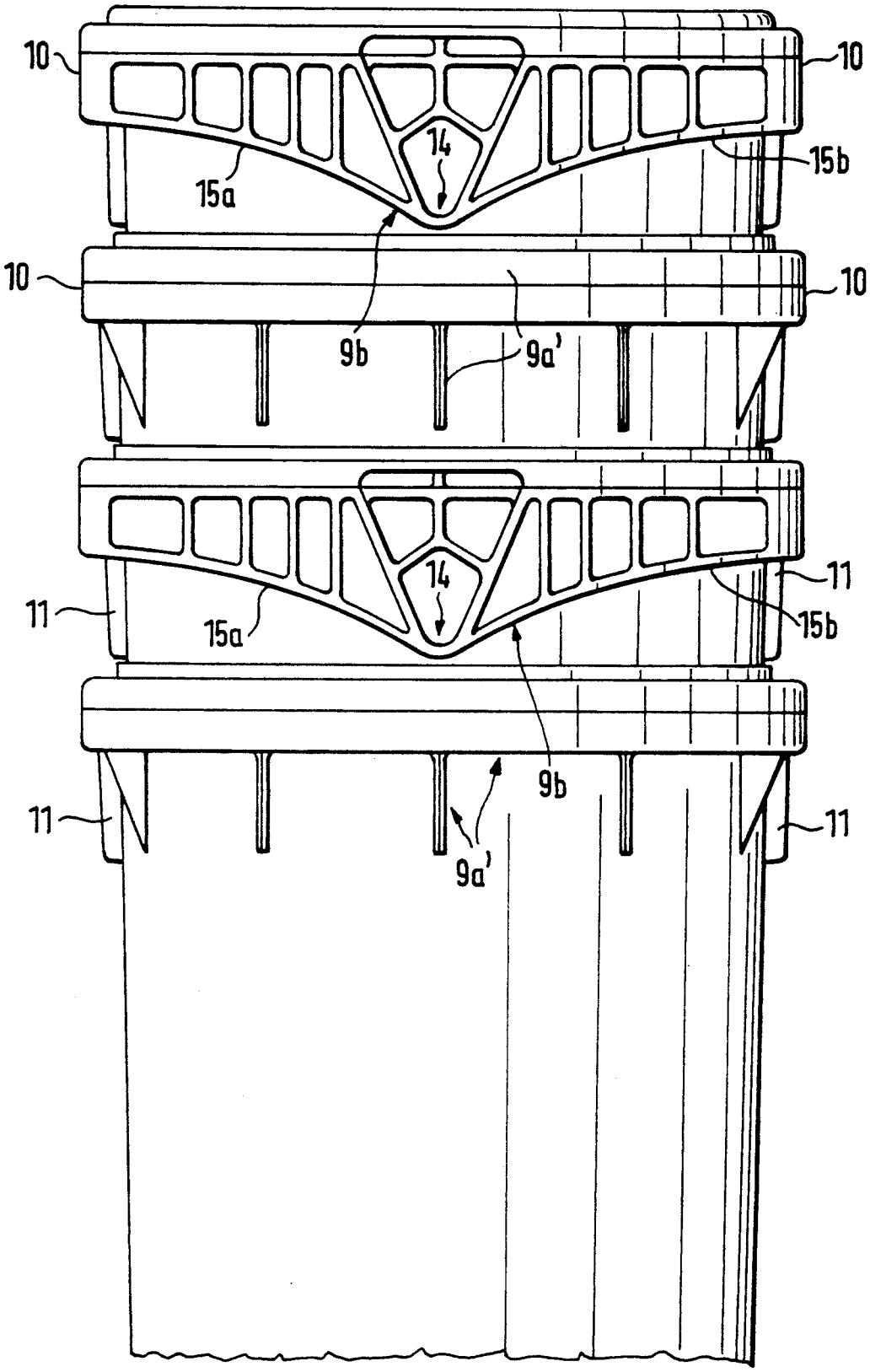
FIG. 6 is a schematic illustration of a stack of empty garbage containers of the type shown in the bottom lefthand side and bottom righthand side of FIG. 1.

FIG. 3 of the drawing shows, on a larger scale, the structural features of the edge structure 9*a*, of the garbage container 4*a* according to FIG. 1, while FIG. 5 shows, also on a larger scale, the edge structure 9*a*" of the garbage container 4*c* according to FIG. 1. FIG. 6 additionally illustrates the structural features of edge structure 9*a*' and FIG. 7 additionally shows the features of the edge structure 9*a*" according to FIG. 1.

Figure 8:
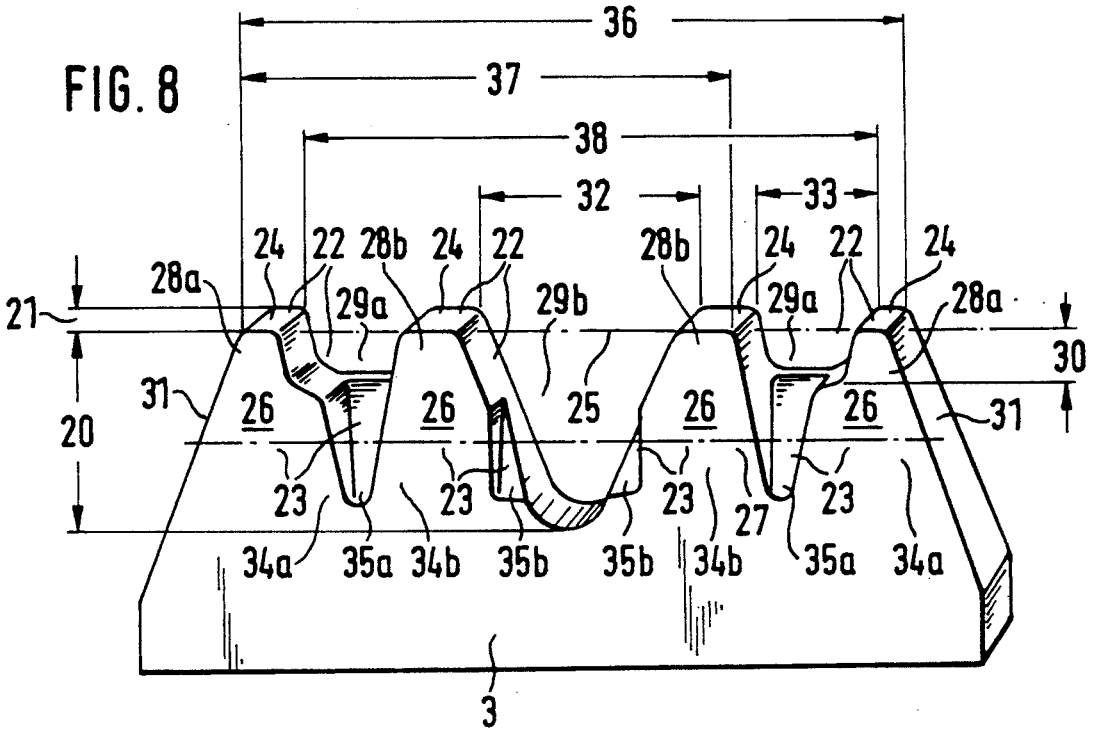
FIG. 8 is a perspective rear view of a receiving member forming a gripping member or gripping rail as it is provided on the lifting and tilting devices of the garbage-collecting vehicle.

Finally, FIG. 8 of the drawing shows in a detailed perspective rear view, the construction of a receiving member 3 constructed as a gripping member or gripping rail. The receiving member 3 is provided on the lifting and tilting unit 2 of the garbage collecting vehicles 1 in order to facilitate a temporary coupling connection with the different edge structures 9*a* or 9*a*', 9*a*" and 9*b* of the garbage containers 4*a*, 4*b*, 4*c* and 4*d* which can be used simultaneously within the garbage collection system.

The particular characterizing feature of the edge structure 9*b* at the front wall 8 of the garbage container 4*c* and 4*d* of FIG. 1 is the fact that on each container body 6 is provided a central rib or web system 13 which is located on the vertical longitudinal median plane and which narrows downwardly approximately in the shape of a triangle. The rib or web system 13 forms a support and centering engagement means 14 for the receiving members 3 located on the lifting and tilting unit 2 of the garbage collecting vehicle 1.

As can be seen particularly in FIG. 11 of the drawing, the rib or web system 13 of this support and centering engagement means 14 is integrally formed with the front wall 8 of the container body 6, such that it projects essentially perpendicularly from the plane of the front wall 8.

The rib or web system 13 of the support and centering engagement means 14 is formed by a circumferential rib 13*a* which defines the triangular shape of the system and by a plurality of stiffening or stabilizing webs 13*b* which are arranged distributed within the circumferential rib 13*a* in the manner of a net.

To the left and right of the support and centering engagement means 14 are arranged a wall portion 15*a* and 15*b* each. The wall portions 15*a* and 15*b* are spaced from the front wall 8 of the container body 6 and are constructed symmetrically relative to each other and symmetrically relative to the longitudinal median plane extending through the support and centering engagement means 14.

The wall portions 15*a* and 15*b* are arranged adjacent to and downwardly from the stiffening collar 10 which is usually arranged around the opening of the container body 6. The stiffening collar 10 has at the bottom thereof a stabilizing rib system 16, as can be seen in FIG. 10.

Each of the two wall portions 15*a* and 15*b* is provided on the outside thereof and distributed over the entire surface thereof with stiffening ribs 17 which extend, for example, perpendicularly, and the lower border rib 18 has, for example, a slightly curved shape, such that the two wall portions 15*a* and 15*b* have a downwardly narrowing shape approximately of a flat triangle which ends at the side walls on the level of the lower edge of the stiffening collar 10.

Between the front wall of the container body 6 and each of the two wall portions 15*a* and 15*b*, a downwardly open receiving pocket portion 19*a* or 19*b* of the edge structure 9*b* is formed on the side of the support and centering engagement means 14, wherein the receiving member 3 of a tilting and lifting unit 2 can be moved into the receiving pocket portion 19*a* or 19*b* (FIG. 10).

Figure 7:
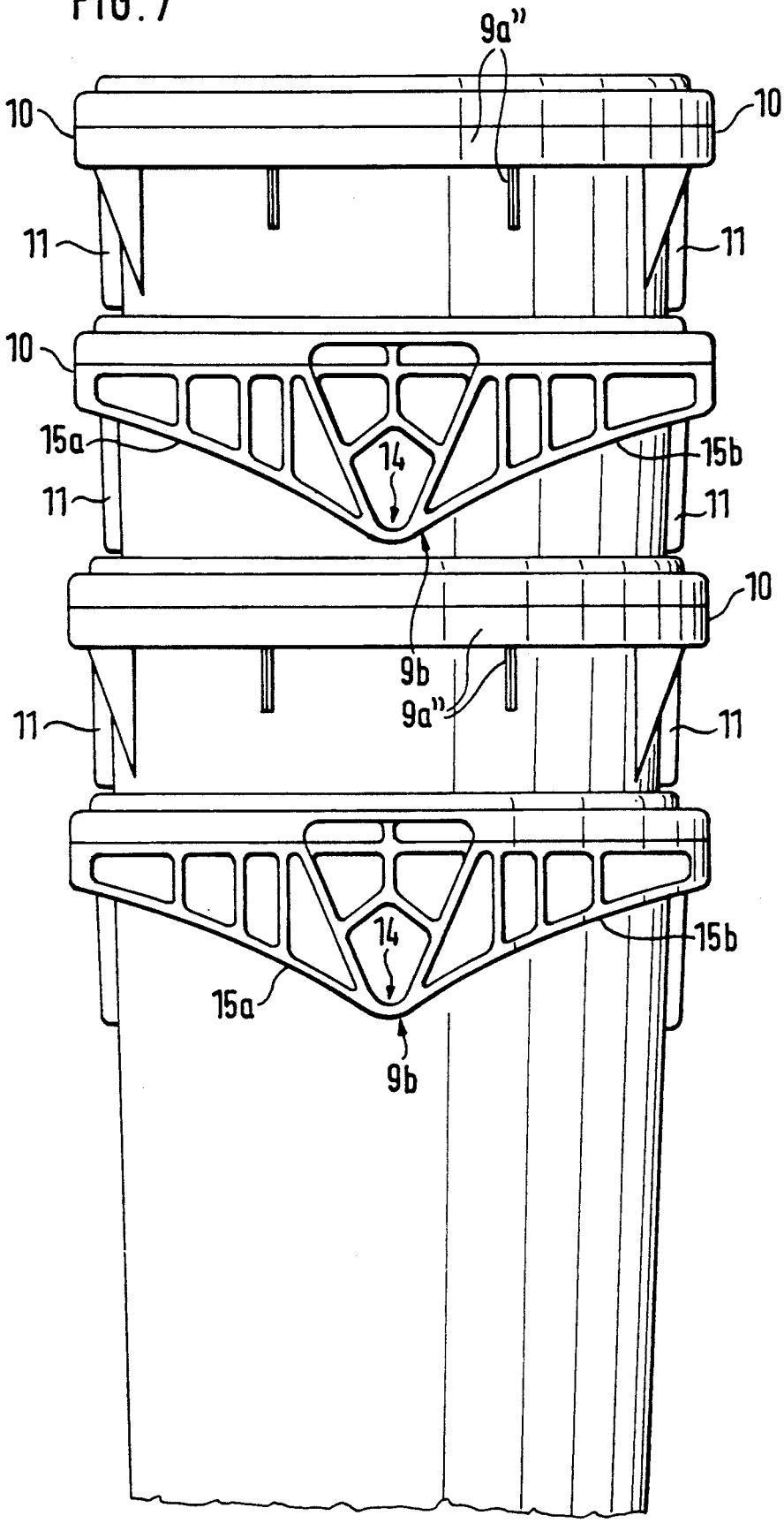
FIG. 7 is a schematic illustration of a stack of empty garbage containers of the type shown in the top lefthand side and bottom righthand side of FIG. 1.

For the edge structure 9*b* on the container bodies 6 of the garbage containers 4*c* and 4*d* particularly shown in FIGS. 2, 4 and 9 to 11, it has been found particularly important that the downwardly directed triangle corners of the support and centering engagement means 14 and of the wall portions 15*a*, 15*b* are located somewhat above the lower ends of the stacking webs 11 formed on the outer circumference of the container body. As can be seen in FIGS. 6 and 7, this ensures that, when several empty garbage containers are stacked within each other, the triangle corners do not rest on the stiffening collars 10 of the next lower garbage container.

To ensure that garbage containers 4*c* and 4*d* with particularly advantageous edge structures can be incorporated without problems as desired into a garbage collection system which previously only used garbage containers 4*a* and 4*b* with edge structures 9*a*' and 9*a*'', it is provided that receiving members 3 constructed as gripping members or gripping rails are used on the lifting and tilting unit 2 which are compatible with any of the edge structures 9*a*', 9*a*'' and 9*b*. A receiving member 3 constructed as gripping member or gripping rail constructed in this manner is shown in a perspective rear view in FIG. 8 of the drawing. However, this receiving member 3 can also be seen in a schematically simplified front view in FIGS. 2–5 and 9 of the drawing.

Important for the compatibility of the receiving member 3 with each of the edge structures 9*a* or 9*a*', 9*a*'' and 9*b* is a particular configuration of the vertical edge region 20 and the horizontal edge region 21 which come into coupling engagement or operative connection with the different edge structures.

As shown, for example, in FIG. 8, the receiving member 3 constructed as gripping member or gripping rail (not shown in FIG. 8) is equipped over its vertical edge region 20 with a tooth-type contour 22 which is oriented parallel to the principal plane thereof. Furthermore, the receiving member 3 has over its horizontal edge region 21 a tooth-type contour 23 which is oriented transversely of the principal plane.

In this connection, an important feature of the receiving member 3 is that the tooth-type contour 22 has top surfaces which extend essentially transversely of the principal plane and are located on a common straight line, and that the front surfaces extending approximately parallel to the principal plane of the tooth-type contour 23 extending transversely to the principal plane are also located on a common straight line 27.

In the illustrated embodiment, the tooth-type contour 22 which is oriented in the direction of the principal plane of the receiving member 3 has four trapezoidally-shaped teeth 28*a* and 28*b* and three tooth gaps 29*a* and 29*b*. The two outer teeth 28*a* are slightly narrower than the two teeth 28*b* in the middle. The two outer tooth gaps 29*a* have the same trapezoidal shape, while the tooth gap 29*b* in the middle has at least approximately a triangular shape which diverges downwardly and which is adapted to the circumferential contour of the support and centering engagement means 14 of the edge structure 9*b* for the garbage containers 4*c* and 4*d*.

As can be seen in FIG. 8 as well as in FIGS. 2–5, the tooth gap 29*b* in the middle has, measured from the top surfaces 24 which are located on a common straight line 25, a depth which extends over the entire vertical edge region 20. The depth of the tooth gap 29*b* corresponds to a multiple, for example, three time to four times the depth 30 of the two outer tooth gaps 29*a* and 29*b*.

It is also worth mentioning that the outer trapeze side 31 of the two outer teeth 28*a* extends with constant inclination at least approximately over the entire height of the receiving member 3 and that the greatest width 32 of the tooth gap 29*b* in the middle is substantially greater than the greatest width 33 of the two outer tooth gaps 29*a* and is, for example, approximately twice the width of the two outer tooth gaps 29*a*.

On the other hand, the tooth-type contour 23 oriented transversely of the principal plane of the receiving member 3 is defined by four teeth 34*a* and 34*b* and four gaps 25*a* and 35*b*. The two outer gaps 35*a* are each arranged in the region of an outer tooth gap 29*a* of the other tooth-type contour 22, while the two inner gaps 35*b* are contiguous with the sides of the tooth gaps 29*b* in the middle of the other tooth-type contour 22.

The two outer gaps 35*a* of the tooth-type contour 23 each have the shape of a pyramid-like downwardly diverging groove, while the two gaps 35*b* in the middle are incisions on the tooth gap in the middle of the other tooth-type contour 22. The gap in the middle has in the direction of the principal plane of the receiving member 3 the circumferential shape of a right-angle triangle whose smallest angle is directed upwardly, while in the direction transversely of the principal plane of the receiving member 3 they have the shape of a right-angle triangle whose smallest angle points downwardly.

As the drawing further shows, the inner side of the two outside gaps 35*a* are arranged in a straight-line extension of the inner side of an outer tooth gap 29*a* of the other tooth-type contour 22.

It is an advantage if the total width 36 of the receiving member 3 in the region of the tooth-type contour 22 oriented in the direction of the principal plane is adapted to the structural width of the edge structure 9*a*' or 9*b* of garbage containers 4*a* and 4*c* having an average volumetric capacity of, for example, 0.12 to 0.24 $m^3$. The outer tooth gaps 29*a* of this tooth-type contour 22 have each an opening which correspond at least to the cross-section of the stiffening collar 10 which is located along the side walls of the container body 6 at the edge structure 9*a'* and 9*b*.

The distance 37 between the outer side of an outer tooth 29*a* and the inner side of the outer tooth gap 29*a* located adjacent the other outer tooth 28*a* is advantageously adapted to the inner width of the edge structure 9*a''* or 9*b* of a garbage container 4*c* or 4*d* having a small volumetric capacity, for example, 0.08 $m^3$.

The distance 38 between the outer side of the two outer tooth gaps 29*a* should also be adapted to the inner width of the edge structure 9*a''* or 9*b* of a garbage container 4*b* or 4*d* having a small volumetric capacity of, for example, 0.08 $m^3$. As is clear from FIGS. 2, 4 and 9 of the drawing, when the receiving member 3 is moved into the edge structure 9*b*, the tooth gap 29*b* in the middle of the tooth-type contour 22 engages the support or centering engagement means 14, while the teeth 28*a* and 28*b* and the tooth gaps 29*a* are introduced into receiving pocket portions 19*a* and 19*b* which are defined on the outside by the wall portion 15*a* and 15*b*. The top surfaces 24 of the teeth 28*a* and 28*b* rest against the stabilizing ribs 16 which are located above the receiving pocket portions 19*a* and 19*b* within the stiffening collar 10.

The edge structure 9*b* formed of the support and centering means 14 in the middle, the two wall portions 15*a*, 15*b* and the receiving pocket portions 19*a* and 19*b* provide for the garbage containers 4*c* and 4*d* a secure and stable support at the receiving member 3 during the entire work movements of the lifting and tilting unit 2.

The tooth gaps 29*a* and 29*b* of the tooth-type contour 22 as well as the gaps 35*a* and 35*b* of the tooth-type contour 23 do not perform a function when the receiving member 3 interacts with the edge structure 9*b* of the garbage containers 4*c* and 4*d*.

However, important for the operation are the tooth gap 29*a* of the tooth-type contour 22 as well as the tooth gaps 35*a* and 35*b* of the tooth-type contour 23 for the use of the receiving member 3 in connection with the garbage containers 4*a* and 4*b* which have an edge structure 9*a* or 9*a'* and 9*a''* as shown in FIGS. 3 and 5 of the drawing.

In the case of the edge structure 2*a'* according to FIG. 3, when the receiving member 3 is inserted, the tooth-type contour 22 reaches coupling engagement through the four teeth 28*a* and 28*b*, while the tooth gap 29*b* in the middle forms a free space for the insertion of the individual middle rib or the individual middle web 12'.

The two outer gaps 35*a* of the other tooth-type contour 23 then serve to receive the two outer individual ribs 12'. When the receiving member 3 is moved into the edge structure 9*a''* of the garbage container 4*b* according to FIG. 5, it is necessary to place the receiving member 3 in a laterally offset position. The laterally offset position is such that one of the outer teeth 28*a* of the tooth-type contour 22 is located laterally outside of the stiffening collar, so that the stiffening collar projects into the adjacent outer tooth gap 29*a*. On the other hand, the other three teeth 28*a* and 28*b* engage the edge structure 9*a''*, such that the left individual rib or left individual web 12'' of the edge structure 9*a''* project into one gap, i.e., the left gap 35*b* of the tooth-type contour 23, while the other individual rib or individual web 12'' projects into the right outer gap 35*a* of this tooth-type contour 23.

By providing the receiving member 3 for the lifting and tilting unit 2 with the two tooth-type contours 22 and 23 arranged in planes extending perpendicularly to each other, it is ensured in a simple manner that the receiving member 3 is compatible with a great number of different edge structures 9*a* or 9*a'*, 9*a''* and 9*b* of garbage containers 4*a* through 4*d*. Accordingly, even when garbage containers 4*a*–4*d* with different edge structures 9*a* or 9*a'*, 9*a''* and 9*b* are used simultaneously, the entire garbage disposal system can be used economically and without problems.

The receiving members provided with the two tooth-type contours 22 and 23 are particularly useful because, in the newly developed garbage containers 4*c* and 4*d*, the edge structure 9*b* is provided with the approximately triangular support and centering engagement 14 which narrows downwardly and which can project into the correspondingly shaped, middle tooth gap 29*b* of the tooth-type contour 22 in the receiving member 3.

Finally, it is pointed out that, in the newly developed garbage containers 4*c* and 4*d*, the edge structure 9 forming the receiving pocket 19*a*, 19*b* may be of a construction which is modified as compared to the construction illustrated in FIGS. 2, 4 and 9–11 of the drawing, if the receiving member 3 constructed as gripping member or gripping rail of the lifting and tilting unit 2 is also adjusted appropriately.

For example, it is easily possible to provide on the garbage container 4*c* and 4*d*, instead of the support and centering engagement means 14 in the middle, two support and centering means 14 which are symmetrically offset from the middle and have an approximate triangular shape which narrows downwardly.

Of course, it would be necessary in this case that, on the receiving member 3 constructed as gripping member or gripping rail of the lifting and tilting unit 2, the two outer tooth gaps 29*a* do not have a trapezoidal shape but a triangular shape which is at least similar to the triangular shape as it is shown in the drawing with respect to the tooth gap 29*b* in the middle.

In the region of the middle tooth gap 29*b* shown in the drawing, the receiving member 3 would only have to be shaped such that the tooth-type contour 23, 35*a*, 35*b* oriented transversely of the principal plane makes it possible that the individual ribs or webs 12' or 12'' of the conventional older type of garbage containers 4*a* and 4*b* are received without damage. For this purpose, it is usually sufficient to cut out of the receiving member 3 the entire region between the two middle gaps 35*b* transversely to the principal plane of the receiving member 3 in the shape of a right-angle triangle whose smallest angle faces downwardly and, if necessary, to provide instead of the triangular middle tooth gap 29*b* a relatively narrow slot portion.

While specific embodiments of the invention have been shown and described in detail to illustrate the inventive principles, it will be understood that the invention may be embodied otherwise without departing from such principles.

I claim:

1. A garbage disposal system, comprising:

garbage containers each having a body with a front wall, and an edge structure located on the front wall so as to form a receiving pocket, each garbage container further having a cover hinged to the body opposite the edge structure;

a garbage-collecting vehicle; and a lifting and tilting unit arranged on the garbage-collecting vehicle for lifting and tilting the garbage containers, the lifting and tilting unit including a receiving member and means for moving the receiving member for temporarily coupling the receiving member to the edge structure of and for lifting and tilting each garbage container, in a region of engagement of the receiving member, the edge structure of the garbage container is divided by ribs into several pocket sections which are distributed along a front side of the container body, the receiving member of the lifting and tilting unit having along an edge portion corresponding to the edge structure of the garbage container a first tooth-like contour oriented parallel to a vertical plane and a second tooth-like contour oriented transversely to the vertical plane, the first tooth-like contour oriented parallel to the vertical plane having top surfaces extending essentially transversely of the vertical plane and the second vertical contour oriented transversely of the vertical plane having end surfaces extending approximately parallel to the vertical plane, the top surfaces and the end surfaces each being located on a common straight line, tooth gaps being defined between the tooth-like contours, the tooth gaps extending in a backward direction from the common straight line so as to have a shape that compliments ribs of different garbage containers.

2. The garbage disposal system according to claim 1, wherein the first tooth-like contour of the receiving member includes four trapezoidally-shaped teeth with three tooth gaps including two outer tooth gaps, wherein the two outer tooth gaps are trapezoidally-shaped, the tooth gap between the outer tooth gaps having an approximately triangular shape.

3. The garbage disposal system according to claim 2, wherein the outer tooth gaps have a depth, the tooth gap between the two outer tooth gaps having a depth which corresponds to a multiple of the depth of the outer tooth gaps.

4. The garbage disposal system according to claim 3, wherein the tooth gap between the two outer tooth gap has a depth which is three to four times the depth of the outer tooth gaps.

5. The garbage disposal system according to claim 2, wherein the two outer tooth gaps have a common depth.

6. The garbage disposal system according to claim 2, wherein the trapezoidally-shaped teeth include two outer teeth having outer trapeze sides, the outer trapeze sides extending with constant inclination at least approximately over the entire height of the receiving member.

7. The garbage disposal system according to claim 2, wherein the tooth gap between the two outer tooth gaps has a greatest width which is substantially greater than a greatest width of the two outer tooth gaps.

8. The garbage disposal system according to claim 7, wherein the greatest width of the tooth gap between the outer tooth gap is approximately twice the greatest width of the two outer tooth gaps.

9. The garbage disposal system according to claim 2, wherein the second tooth-like contour of the receiving member is defined by four teeth and four tooth gaps including two inner tooth gaps and two outer tooth gaps, the outer tooth gaps of the second tooth-like contour being located in a region of an outer tooth gap of the first tooth-like contour, and the two inner tooth gaps adjoining the sides of the tooth gap between the outer tooth gaps of the first tooth-like contour.

10. The garbage disposal system according to claim 9, wherein the two outer tooth gaps of the second tooth-like contour are each formed by a groove that diverges from bottom to top in a pyramid-like manner, the two inner tooth gaps being formed by incisions in sides of the tooth gap between the outer tooth gaps of the first tooth-like contour, the two inner tooth gaps have, in a direction of a vertical plane of the receiving member, a right-angled triangle shape whose smallest angle is directly upwardly, and, the inner tooth gaps further have, in a direction transverse to the vertical plane of the receiving member, a right-angled triangle shape whose smallest angle faces downwardly.

11. The garbage disposal system according to claim 10, wherein the two outer tooth gaps of the second tooth-like contour have inner sides which are arranged in a straight-line extension of an inner side of an outer tooth gap of the first tooth-like contour.

12. The garbage disposal system according to claim 9, wherein the garbage container body has sidewalls and a stiffening collar located along the side walls adjacent to the edge structure, the receiving member having, in a region of the first tooth-like contour, a total width which is adapted to a structural width of the edge structure of a garbage container having an average volumetric capacity of 0.12 to 0.24 $m^3$, the outer tooth gaps of the first tooth-like contour each have an opening width which corresponds at least to a cross-section of the stiffening collar of the garbage container body.

13. The garbage disposal system according to claim 3, wherein a distance between an outer side of an outer tooth and an inner side of an outer tooth gap adjacent the outer tooth is adapted to an inside dimension of the edge structure of a garbage container having a small volumetric capacity of 0.08 $m^3$.

14. The garbage disposal system according to claim 13, wherein a distance between inner sides of the two outer tooth gaps is adapted to the inside dimension of the edge structure of a garbage container having a small volumetric capacity of 0.08 $m^3$.

15. The garbage disposal system according to claim 2, wherein the edge structure of the garbage container includes a central rib system which narrows downwardly in a triangular shape so as to form support and centering engagement means for the tooth gap between the outer tooth gaps of the first tooth-like contour, the tooth gap between the outer tooth gaps having an approximately triangular shape.

16. The garbage disposal system according to claim 15, wherein the edge structure forming the receiving pocket has an outer wall with a border which narrows downwardly with an approximately flat triangle shape, the border having an outer surface provided with stiffening ribs.

17. The garbage disposal system according to claim 16, comprising stacking webs formed on the outer circumference of the container body, wherein lower ends of the support and centering engagement means and of the outer wall of the edge structure are located above a lower end of the stacking webs.

* * * * *